US010130868B2

(12) United States Patent
Jackson

(10) Patent No.: US 10,130,868 B2
(45) Date of Patent: Nov. 20, 2018

(54) TWO-GAME INSTANT TICKET WITH SIMULTANEOUS PLAY

(71) Applicant: Kathleen Nylund Jackson, Scituate, MA (US)

(72) Inventor: Kathleen Nylund Jackson, Scituate, MA (US)

(73) Assignee: Precedent Gaming, Inc., Newport, NC (US)

( * ) Notice: Subject to any disclaimer, the term of this patent is extended or adjusted under 35 U.S.C. 154(b) by 311 days.

(21) Appl. No.: 14/951,474

(22) Filed: Nov. 24, 2015

(65) Prior Publication Data

US 2016/0151702 A1 Jun. 2, 2016

Related U.S. Application Data

(60) Provisional application No. 62/123,906, filed on Dec. 2, 2014.

(51) Int. Cl.
*A63F 3/06* (2006.01)

(52) U.S. Cl.
CPC ..... *A63F 3/0665* (2013.01)

(58) Field of Classification Search
CPC ..... A63F 3/0665
USPC ..... 283/72, 94, 98, 100, 903; 273/138.1, 273/139, 269
See application file for complete search history.

(56) References Cited

U.S. PATENT DOCUMENTS 5,092,598 A * 3/1992 Kamille ..... A63F 3/0665 283/102
5,158,293 A 10/1992 Mullins
5,743,524 A 4/1998 Nannicola
5,934,671 A 8/1999 Harrison
6,241,246 B1 6/2001 Guttin et al.
6,612,576 B1 9/2003 Stancik et al.
6,698,755 B2 3/2004 Cherry
6,761,633 B2 7/2004 Riendeau et al.
6,918,589 B2 7/2005 Thibault
6,926,273 B1 8/2005 Vancura
7,004,506 B2 2/2006 Downes et al.
7,410,168 B2 8/2008 Gumina
7,429,044 B2 9/2008 O'Brien
7,431,295 B2 10/2008 Scymgeour et al.
7,458,580 B2 12/2008 Martineck et al.
7,481,432 B2 1/2009 Feola
7,497,778 B2 3/2009 Bozeman
7,510,116 B2 3/2009 Robb et al.
7,867,075 B2 1/2011 Irwin et al.
7,959,503 B2 6/2011 Streeter et al.
7,980,559 B2 7/2011 Miller et al.
8,221,208 B2 7/2012 Hill et al.
8,231,449 B2 7/2012 Martineck
8,298,061 B2 10/2012 DeLise
8,333,380 B2 12/2012 Berkowitz
8,460,081 B2 6/2013 Meyer
8,512,123 B2 8/2013 Stanek et al.
8,628,082 B2 1/2014 Martineck
(Continued)

*Primary Examiner* — Justin V Lewis

(57) ABSTRACT

A method of playing a lottery instant scratch ticket game comprises a plurality of physical tickets, wherein each ticket provides one printed grid that is common to two different play and pay methods. The two play and pay methods are performed simultaneously, and provide differing prizes. A highest jackpot prize is offered for only one of the play methods.

13 Claims, 11 Drawing Sheets

(56) References Cited

U.S. PATENT DOCUMENTS

| | | | |
|---|---|---|---|
| 8,672,325 | B2 | 3/2014 | Green |
| 8,727,853 | B2 | 5/2014 | Katz et al. |
| 2003/0062677 | A1 | 4/2003 | Streeks |
| 2003/0178770 | A1 | 9/2003 | Stewart |
| 2006/0197283 | A1 | 9/2006 | Thinnes |
| 2007/0187888 | A1 | 8/2007 | Dures et al. |
| 2009/0098922 | A1 | 4/2009 | Cummings et al. |
| 2009/0253481 | A1 | 10/2009 | Honour |
| 2011/0003628 | A1 | 1/2011 | Marino |

* cited by examiner

TWO-GAME INSTANT TICKET WITH SIMULTANEOUS PLAY

RELATED APPLICATION DATA

This application claims priority from U.S. Provisional Patent Application Ser. No. 62/123,906, filed Dec. 2, 2014, and having the Title TWO-GAME INSTANT WITH SIMULTANEOUS PLAY.

BACKGROUND OF THE INVENTION

1. Field of the Invention

The present invention relates to an instant game ticket (otherwise known in the art as a "scratch ticket"). The invention further relates to lottery gaming wherein a physical instant game ticket may be purchased and verified at a lottery agent location or other suitable locations, the ticket utilizing a gameplay that provides prizes based on two separate symbol sets and one common grid. In a separate embodiment, the instant scratch ticket may be electronic and displayed on a monitor screen.

2. Background of the Art

For nearly 50 years, scratch tickets have been offered for sale as part of state and national lotteries. These tickets typically have an array of winning numbers and an array of player numbers, each concealed by a removable film. The player scratches off the film to reveal the numbers. If a winning number matches a player number, a prize is won. A major drawback lies in the simplicity of the typical game—simply scratching and matching numbers can get boring. Another drawback is that these simple games are very quick, hence the term "instant ticket". To remedy that time-to-play element, extended play tickets have recently become popular, although a large number of players find these tickets too tedious for instant gratification. A dedicated smaller number of players, however, find these tickets irresistible. In Massachusetts, the country's most lucrative lottery in terms of revenue, the most popular ticket is the extended play $2 Cashword®, although it is estimated that only 15%-20% of players choose to play them.

Scratch ticket games are provided wherein a predetermined number of tickets are printed, each ticket providing either a losing result or a winning result. The amount of tickets with losing results is predetermined, as are the number of tickets with winning results. Also predetermined is the number of tickets for each individual win amount. The total amount of awards of the winning tickets will be less than the total cost of all tickets in the game. For instance, a total of 90,720,000 $5 tickets may be printed and sold. The total ticket sales will be $453,600,000. The total payout to players may be $345,471,000.

Since the revenues from scratch ticket sales benefit cities, towns and schools, states in particular have a vested interest in providing new and exciting games that will keep the players buying the tickets and playing the games.

Various attempts have been made to create new instant games with unique gameplay that may take longer to play in order to increase player participation and enjoyment.

U.S. Pat. No. 8,672,325 (Green) discloses methods and apparatus for playing an instant win gaming ticket wherein the instant win gaming ticket has multiple instant win games that can be played by the player. The amount won per game is dependent on the results of at least one previous game on the same ticket. The player plays the games on a single ticket and the amount the player wins for each game depends on whether previously played games on the same ticket were won or lost. A drawback of this method is the requirement of previous wins in order to win greater awards.

U.S. Pat. No. 8,512,123 (Stanek, et al.) provides a method and associated lottery game card/ticket for implementing a ticket-based, multi-component lottery game and includes providing lottery tickets for players, wherein the lottery tickets include a first game component with a first prize structure and at least one additional game component with a separate second prize structure. In particular, the hybrid ticket comprises two components: a standard instant ticket game and an additional game that is an interactive game over the internet. A separate validation code is provided for each game component. This method is of a disadvantage to players who are not internet-savvy, or who have no access to the internet. In addition, a player who prefers a truly instant win would most likely not be drawn to the method.

U.S. Pat. No. 8,333,380 (Berkowitz) discloses an instant lottery ticket game wherein a scratch-off material is removed from a first playing area of the ticket, and if three or more like kind outcome indicia are revealed, the ticket is a winner; however, if three or more like kind outcome indicia are not revealed in the first playing area, a scratch-off covering material is removed from a second playing area to reveal a "Bonus" prize award, so that every ticket is a winning ticket. A disadvantage to this method is that by providing a guaranteed win on each ticket, the prize structure must necessarily offer less frequent amounts of larger prizes, or smaller jackpot amounts.

U.S. Pat. No. 7,004,506 (Downes et al.) discloses a lottery ticket having a first game area having at least one row with each row containing a plurality of play indicia and a second game area adjacent each row of the first game area and containing a target indicia which if present may result in a prize being won. The second game area is not a separate game, but rather is merely an area displaying the terms of a win in the adjacent row.

U.S. Pat. No. 6,698,755 (Cherry) teaches a lottery-type game of chance for a plurality of players that employs pulltabs, at least some of the pulltabs comprising one or more immediate instant win award indicators. Some of the pulltabs comprise a bonus ticket symbol that entitles the holder to receive a set of bonus tickets. Some of the bonus tickets have printed on them one or more instant win awards. The bonus tickets do not guarantee a win.

U.S. Pat. No. 6,612,576 (Stancik, et al.) discloses a lottery-type game of chance for a plurality of players employs break open tickets, at least some of the tickets having printed on them game symbols that provide one or more instant win awards. The awards are covered, prior to play, with one or more removable cover members such as flaps or scratch-off seals. Some of the tickets include one or more eligible game symbols that entitle the ticket holder to enter a bonus round of play. The instant-win game symbols are not displayed in a same row as those of the eligible game symbols, and so there is no relationship between the two symbol games.

U.S. Pat. No. 5,743,524 (Nannicola) discloses a mountain climbing theme game employing seal cards or scratch off cards to indicate which player will be eligible to ascend to a further level in the game. In addition to providing a separate, unrelated instant win, this method allows the player to advance to further levels by choosing a scratch-off area that may or may not contain the one advancement symbol guaranteed in each play level. Each successive play level provides progressively higher awards. A downside of this method is that the player may feel frustrated with choosing the wrong symbol area to scratch, knowing that a different choice may have provided awards or kept him in the game.

Each of the references discussed in this text art are incorporated herein in their entirety for all purposes.

It is an objective of the present invention to remedy the deficiencies in the prior art, and to provide players with new and enticing gameplay features that will stimulate player interest and increase participation in instant lottery games. It is also a goal of the present invention to provide an instant ticket game that takes a somewhat longer time to play than the traditional scratch-and-match ticket, yet not as long as a typical extended play ticket such as Cashword® or Bingo®.

SUMMARY OF THE INVENTION

The present invention discloses a method of playing a lottery instant scratch ticket game comprising a plurality of physical tickets, wherein each ticket provides one printed grid that is common to two different play and pay methods. The grid comprises rows of symbol boxes, with each successive row comprising an ever-decrementing amount of symbol boxes. The final row of symbol boxes comprises one symbol box. Each symbol box contains one game symbol from either a first predetermined set of advancement symbols or a second predetermined set of play symbols. Each symbol box is covered with an opaque scratchable film that is labeled by one unique symbol from the first set of symbols. Preferably the first set of symbols comprises numbers, and the symbol boxes in the first row are each labeled by one of the numbers so that the amount of number labels equal the amount of numbers in the first symbol set. Preferably the second set of symbols comprises icons such as basic geometric shapes (circle, square, star, triangle, for instance) or theme-based graphic symbols (moneybag, coins, money tree, jewel, for instance). To begin the game, the player scratches off all of the symbols in a first row comprised of the largest amount of symbol boxes to reveal the game symbol in each symbol box. The film removal method continues by removing the opaque film over any symbol area in a second row that matches a game symbol revealed in the first row of symbol boxes, and further continues by removing the opaque film over any symbol area in each successive row of symbol boxes that matches a game symbol revealed in the previous row of symbol boxes. A prize is guaranteed if the single symbol box in the final row of symbol boxes is ultimately revealed. If three matching symbols from the second set of symbols are revealed in any one row, the player is afforded a prize according to a predetermined prize legend. The amount of symbols from the first predetermined set of game symbols and the amount of second predetermined set of game symbols in any one row are interrelated in that a larger amount of numbers in comparison to the amount of icons provides a perceived greater chance to ultimately reach the guaranteed prize, while a larger amount of icons in comparison to the amount of numbers provides a perceived greater chance to win a prize according to the prize legend.

DETAILED DESCRIPTION OF THE INVENTION

Figure 1:
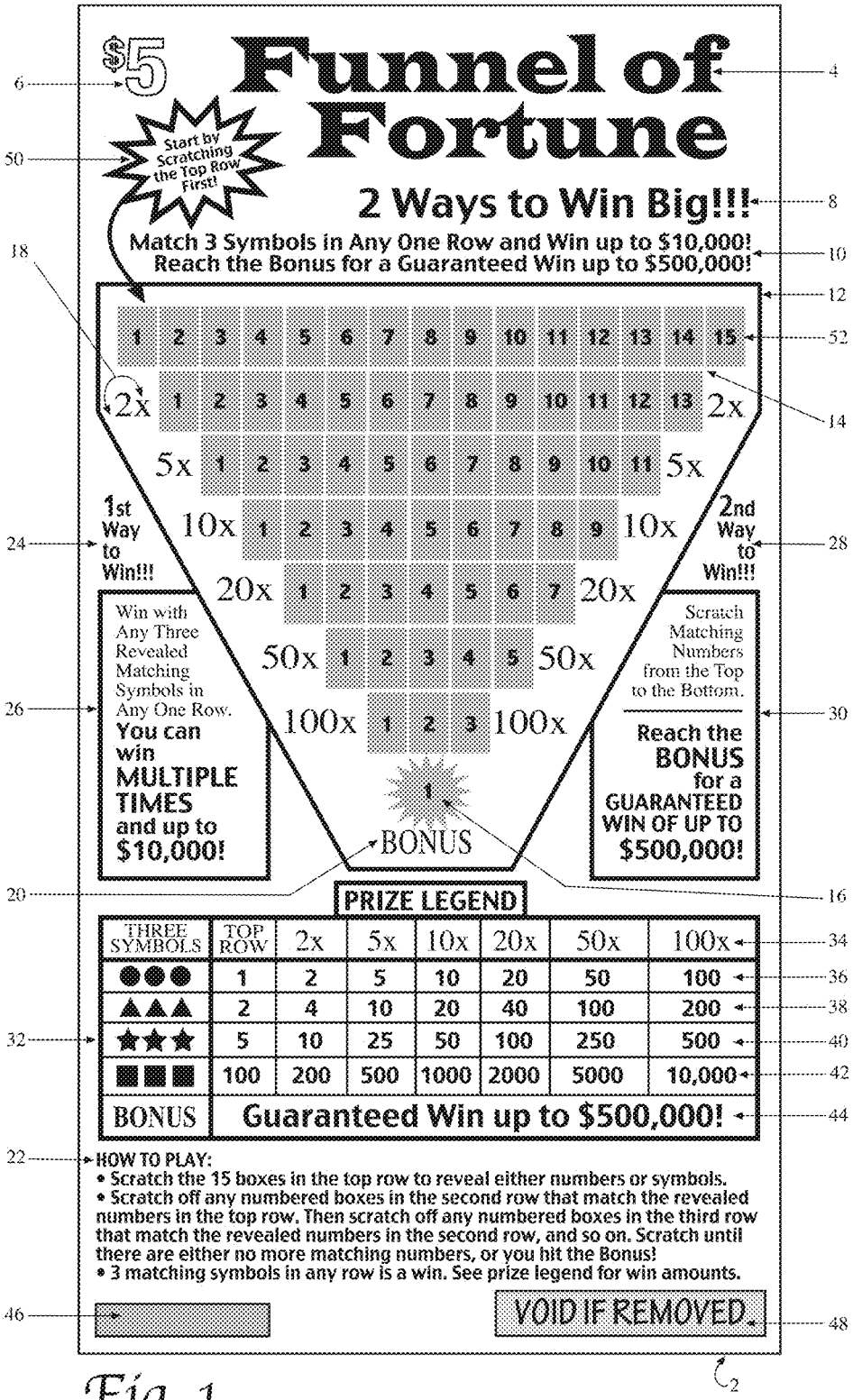
FIG. 1 shows a first example of a preferred embodiment of the present invention comprising the game elements for an instant ticket game utilizing the game technology described herein.

The present invention discloses a lottery game in which a plurality of instant scratch tickets is provided. The present invention describes the physical lottery instant scratch ticket, and the method of play thereof. A wager of cash, credits or non-monetary points may be required to play the game. The denomination and name of the game are preferably printed on the ticket, as well as play instructions. A printed security code may be provided and concealed by an opaque film. The said security code provides an encryption that guarantees that the ticket is valid and maintains the authenticity of the instant game ticket.

The ticket provides a printed game grid comprised of at least three rows of symbol areas or "boxes", each successive row comprising a decrementing amount of symbol boxes. For instance, in a three-row configuration, a first row may comprise three symbol boxes, a second row may comprise two symbol boxes, and a third (or last) row preferably comprises one symbol box. Alternately, the first row may comprise ten symbol boxes, the second row may comprise five symbol boxes, and the last row preferably comprises one symbol box. It should be appreciated that other configurations such as a circular, rectangular or other predetermined geometric grid may be utilized, comprised of concentric rings of symbol boxes. The outermost ring is a first "row", and the center ring is a last "row". Two separate predetermined sets of game symbols are provided. The first symbol set comprises advancement symbols, and comprises the same amount of symbols as the amount of symbol boxes in the first row. The second symbol set comprises a predetermined amount of play symbols that differ from the symbols in the first symbol set. Each symbol box in any one row of symbol boxes contains either one unique (non-repeating) symbol from the first symbol set, or one symbol from the second symbol set. In both the row configuration and the circular configuration, each symbol box is covered by a labeled opaque removable film, with a game symbol being concealed within each symbol box. Each symbol box label in any one row of symbol boxes consists of a unique (non-repeating) advancement symbol from the first symbol set, preferably a number or a letter. For the sake of clarity, this detailed explanation of the present invention will utilize individual unique numbers as the preferred symbols in the first symbol set, although letters or other simple symbols (stars, circles, squares and the like) may be used. The total amount of unique numbers in the first symbol set equals the total amount of symbol boxes in the first row. The number labels may be displayed in a non-ordinal fashion, but are preferably displayed in an ordinal fashion. For example, in an ordinal numbered grid comprising five rows, the first row would be labeled, from left to right,1-2-3-4-5, the second row would be labeled 1-2-3-4, the third row would be labeled 1-2-3, the fourth row would be labeled 1-2, and the last row would be labeled 1. In a non-ordinal numbered grid comprising five rows, the first row may be labeled, from left to right, 2-4 -1-3-5, the second row may be labeled 4-3-2-1, the third row may be labeled 1-2-3, the fourth row may be labeled 2-1, and the last row may be labeled 1. It is also contemplated that any of all of the unique numbers in the first symbol set may be utilized to label the symbol boxes in any one row. For example, in a non-ordinal numbered grid comprised of five rows, the first row may be labeled, from left to right, 2-4-1-3-5, the second row may be labeled 5-3-4-1, the third row may be labeled 1-5-3, the fourth row may be labeled 3-4, and the last row may be labeled 2.

Each row of symbol boxes preferably has a multiplier associated with it, although it is not mandatory. For example in a five-row grid, the first row may afford a 1× multiplier, the second row may afford a 3× multiplier, the third row may afford a 5× multiplier, the fourth row may afford a 10× multiplier, and the last row may afford a 100× multiplier. In a preferred embodiment, the last row may not afford a multiplier.

A prize legend is also provided. The prize legend describes various winning play symbol combinations from the second predetermined game symbol set. Each play symbol (circle, square, star, triangle, for instance) has a separate predetermined value. At least two, but preferably three, like symbols in any one row provides a winning value. The value of a winning combination in any one row is multiplied by the multiplier associated with that row if a multiplier is afforded for that row. It may be possible to achieve more than one winning combination in any one row, and/or more than one winning combination in the grid.

In a preferred embodiment of the present invention, a plurality of physical scratch tickets is provided. A game grid is printed on each ticket that comprises a predetermined amount of symbol boxes and each symbol box contains a printed game symbol from either a first predetermined set of game symbols or a second predetermined set of game symbols. The game symbols in the first symbol set are advancement symbols, and do not have a value. The game symbols in the second symbol set are play symbols, and are valued according to a predetermined prize legend. The symbol boxes are displayed in at least three horizontal rows wherein a first row of symbol boxes comprises a largest amount of symbol boxes. Each successive row of symbol boxes comprises an ever-decrementing amount of symbol boxes, with the last row of symbol boxes comprising a single symbol box. The said single symbol box is the only symbol box that contains a prize symbol instead of an advancement or play symbol. Each symbol box is covered by an opaque removable film, the opaque removable film being labeled by a unique game symbol from the first symbol set. A prize legend is provided, comprising a predetermined paytable for three like play symbols in any one row of symbol boxes. A film removal method is provided wherein the opaque film over all the symbol boxes in the first row of symbol boxes is removed to reveal the game symbol in each symbol box. The film removal method is continued by removing the opaque film over any symbol box in the second row that matches a game symbol from the first set of game symbols revealed in the first row of symbol boxes, and then by removing the opaque film over any symbol box in each successive row of symbol boxes that matches a game symbol from the first set of game symbols revealed in the previous row of symbol boxes. A guaranteed winning result is provided if the single symbol box in the last row of symbol boxes is ultimately revealed employing the film removal method. All revealed play symbols in any one row of symbol boxes are then analyzed to determine if there are any wins according to the predetermined prize legend. In order to verify any winning amount, a verification code is revealed by scratching off the overlaying opaque film. Any winning ticket (according to the verification code) is then reverified by a security code by processing the ticket through a computer terminal comprised of at least a computer processor at a lottery agent location or other suitable locations. The security code is revealed and processed at this time to ensure the authenticity of the ticket.

In a first example of the preferred embodiment, a game grid of eight rows (a first row comprising 15 symbol boxes numbered 1-15 respectively, a second row comprising 13 symbol boxes numbered 1-13 respectively, a third row comprising 11 symbol boxes numbered 1-11 respectively, a fourth row comprising 9 symbol boxes numbered 1-9 respectively, a fifth row comprising 7 symbol boxes numbered 1-7 respectively, a sixth row comprising 5 symbol boxes numbered 1-5 respectively, a seventh row comprising 3 symbol boxes numbered 1-3 respectively, and an eighth row comprising a single symbol box numbered 1) is provided. Each row except the final row has a multiplier associated with it (the first row provides a 1× multiplier, the second row provides a 2× multiplier, the third row provides a 5× multiplier, the fourth row provides a 10× multiplier, the fifth row provides a 20× multiplier, the sixth row provides a 50× multiplier, and the seventh row provides a 1× multiplier). Upon purchase of the instant scratch ticket, the player is prompted according to the play instructions to first remove or "scratch off" the labeled (numbered) opaque film covering all of fifteen symbol boxes (labeled 1-15) in the first row of the grid, revealing both non-repeating symbols from the advancement symbol set and repeatable symbols from the play symbol set. Any revealed advancement symbols in any one row preferably comprise only advancement symbols that may match a number label in the next (proceeding) row. The player is then prompted to scratch off the numbered opaque film covering each symbol box in the second row that matches an advancement symbol revealed in the first row. The player is then prompted to scratch off the numbered opaque film covering each symbol box in the third row that matches an advancement symbol revealed in the second row. Symbol boxes in each proceeding row are scratched accordingly, until there are either no more advancement symbols revealed or until a prize symbol in the last single symbol box is revealed. The revealed prize symbol in the last single symbol box is a guaranteed bonus win, and its value is awarded to the player. After all of the specific symbol boxes have been scratched according to the scratch-off method described, all of the revealed play symbols in any one row and its multiplier are compared to the prize legend in order to determine any prizes won. It may be possible to win only the guaranteed bonus win, only any prizes determined by the prize legend, or both. It is preferable that wins according to the prize legend comprise a set of prizes up to a maximum amount without including a highest jackpot amount, and guaranteed bonus wins comprise a set of prizes including at least the highest jackpot amount. In order to verify any winning amount, a verification code is revealed by scratching off the overlaying opaque film. Any winning ticket (according to the verification code) is then reverified by a security code by processing the ticket through a computer terminal comprised of at least a computer processor at a lottery agent location or other suitable locations. The security code is revealed and processed at this time to ensure the authenticity of the ticket.

In a second example of the preferred embodiment, an alternate circular game grid of seven rings (a first outer ring comprising 7 symbol boxes numbered 1-7, a second ring comprising 6 symbol boxes numbered 1-6, a third ring comprising 5 symbol boxes numbered 1-5, a fourth ring comprising 4 symbol boxes numbered 1-4, a fifth ring comprising 3 symbol boxes numbered 1-3, a sixth ring comprising 2 symbol boxes numbered 1-2, and a seventh (center) ring comprising one symbol box numbered 1) is provided. The method of gameplay is the same as in the first example of the preferred embodiment of the present invention.

Reference to the Figures will assist in further understanding of the practice of the present invention.

FIG. 1 illustrates the first example of the preferred embodiment of the present invention, providing the elements of present invention that afford the specific gameplay thereof. A physical lottery instant game ticket 2 is provided, comprising a game ticket name 4, the denomination of the ticket 6, a headline that entices play 8, and a brief description of the ways to win and how much you can win 10. A game play area 12 is shown, comprising a game grid 14 that comprises eight rows of symbol boxes covered by an opaque removable film (as illustrated by a grey dot pattern), and labeled by a number. There are fifteen symbol boxes in the first (top row) 52, numbered 1 through 15. The next row down comprises thirteen symbol boxes numbered 1 through 13. Each successive row comprises two less labeled symbol boxes, with the last symbol row (a single starburst) 16 being labeled by the number 1. Adjacent all of the symbol rows except for the first and last row provide a multiplier 18. The starburst symbol box 16 is shown to be a guaranteed Bonus 20. Play instructions 22 are shown, along with a more detailed explanation of a first way to win 24, 26 and a second way to win 28, 30. A prize legend 32 is shown, comprising a header row 34 defining each column in the game grid 14 by its respective multiplier, a next row 36 showing the prizes (in $) for three circle play symbols in each particular row of the game grid, a next row 38 showing the prizes (in $) for three triangle play symbols in each particular row of the game grid, a next row 40 showing the prizes (in $) for three star play symbols in each particular row of the game grid, and a next row 42 showing the prizes (in $) for three square play symbols in each particular row of the game grid. The Bonus is shown to be a guaranteed win of up to $500,000 44. Also shown are a concealed verification code box 46 and a concealed security code 48. A starburst symbol 50 explains how to start the game by first scratching off all the symbol boxes in the first row 52.

Figure 2:
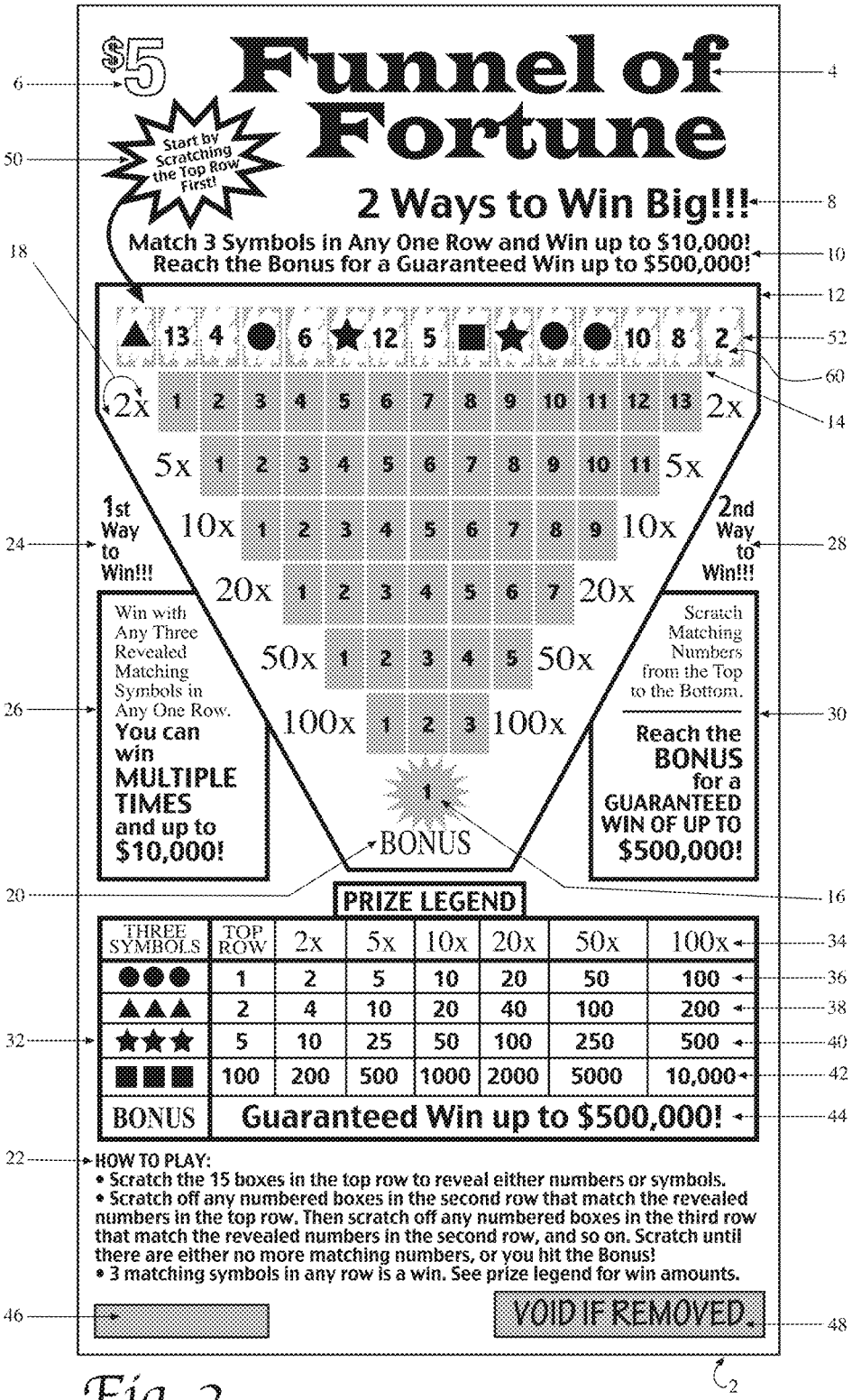
FIG. 2 shows the game technology at a beginning stage.

FIG. 2 shows the elements of FIG. 1 wherein the player has first removed or "scratched off" the labeled opaque film 60 over the fifteen boxes in the first row 52, revealing seven play symbols (one triangle, one square, two stars and three circles) and eight advancement symbols (in numerical order, 2, 4, 5, 6, 8, 10, 12, 13). Since there are three revealed circles, the player wins $1 according to the prize legend 32.

Figure 3:
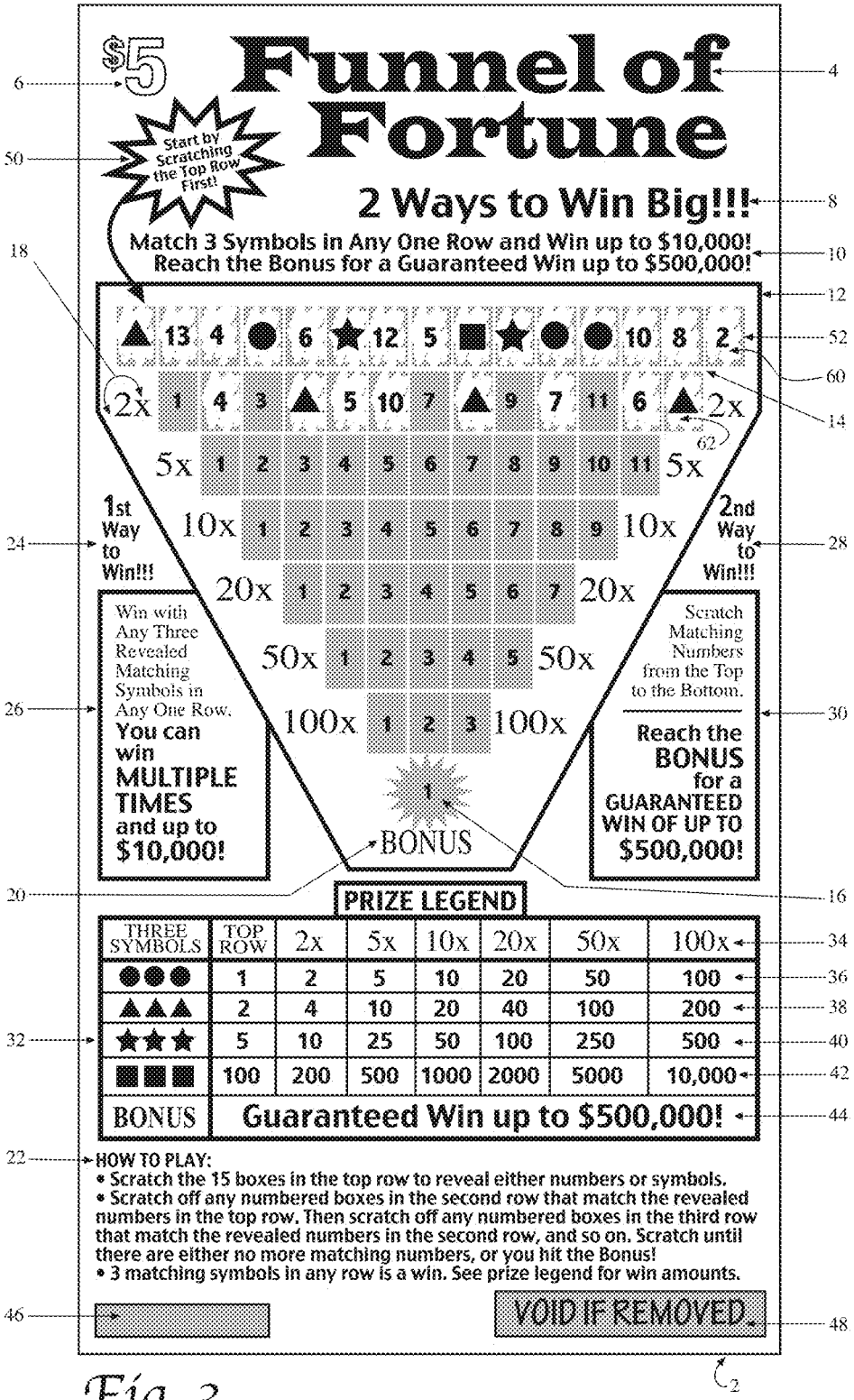
FIG. 3 shows the game technology at a later stage.

FIG. 3 shows the elements of FIG. 2 wherein the player has scratched off the labeled opaque film 62 over the eight boxes in the second row that match the advancement symbols in the first row, revealing three play symbols (three triangles) and five advancement symbols (in numerical order, 4, 5, 6, 7, 10). Since there are three revealed triangles, the player wins $4 according to the prize legend 32.

Figure 4:
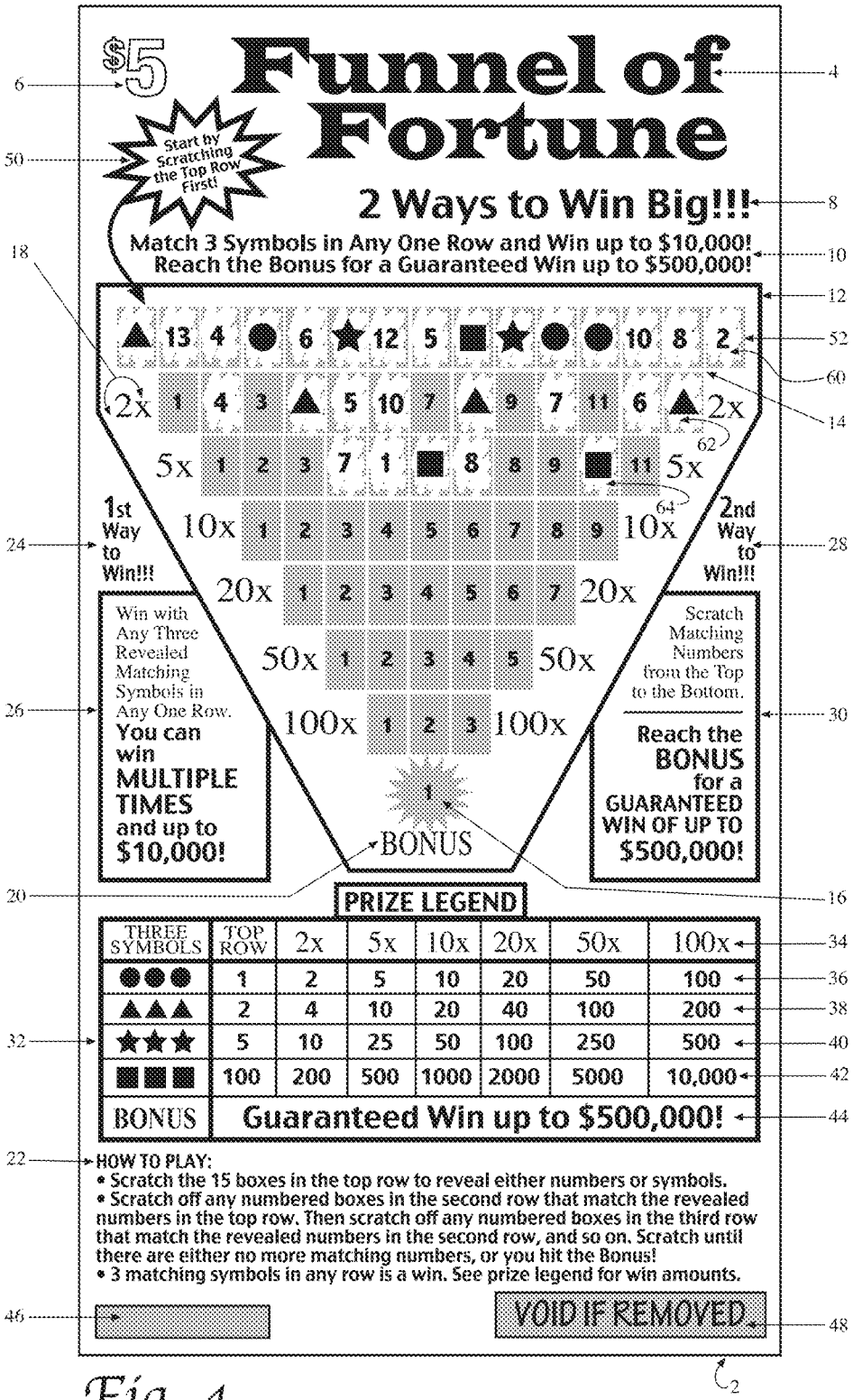
FIG. 4 shows the game technology at a later stage.

FIG. 4 shows the elements of FIG. 3 wherein the player has scratched off the labeled opaque film 64 over the five boxes in the third row that match the advancement symbols in the second row, revealing two play symbols (two squares) and three advancement symbols (in numerical order, 1, 7, 8). There are no play symbol wins.

Figure 5:
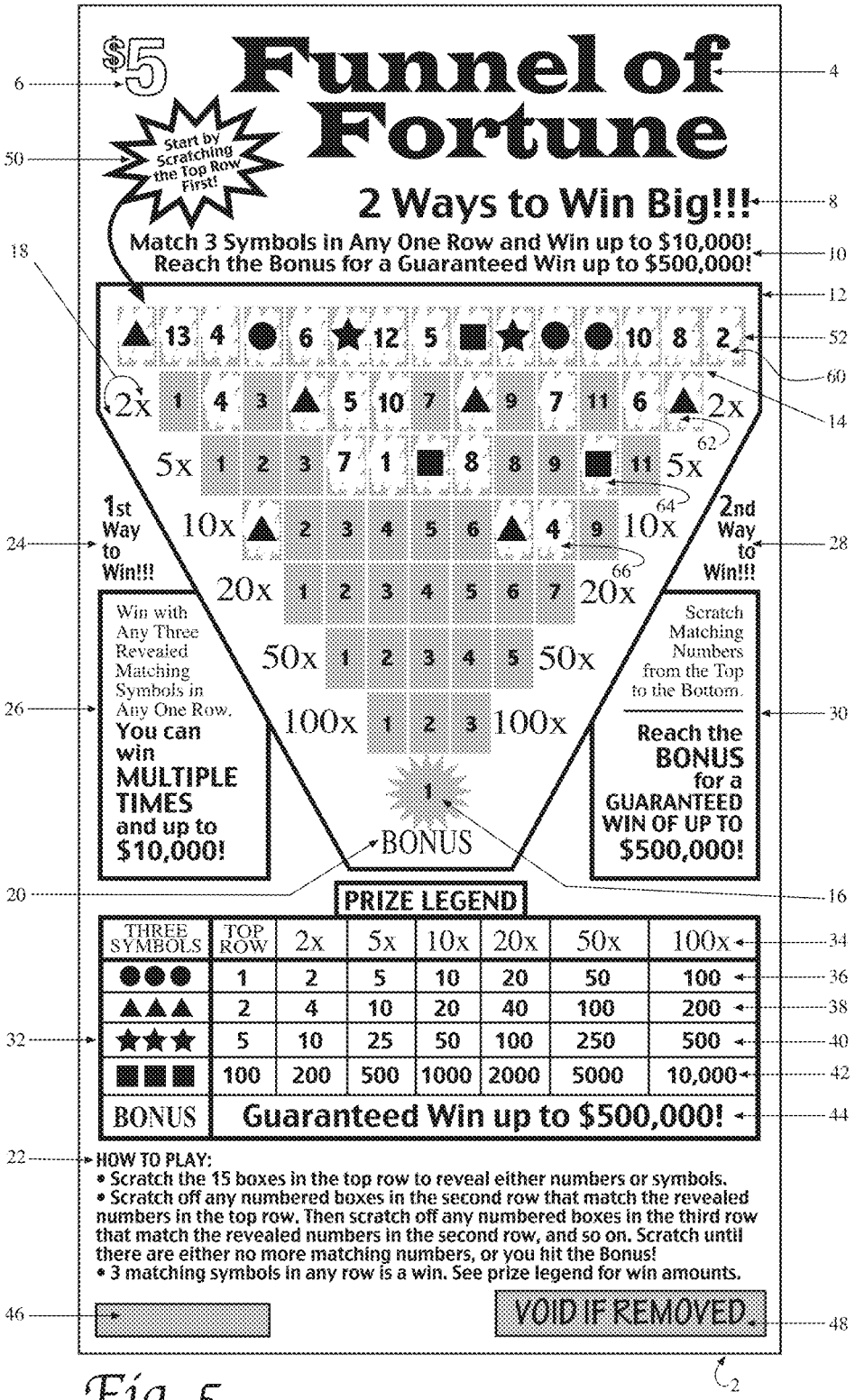
FIG. 5 shows the game technology at a later stage.

FIG. 5 shows the elements of FIG. 4 wherein the player has scratched off the labeled opaque film 66 over the three boxes in the fourth row that match the advancement symbols in the third row, revealing two play symbols (two triangles) and one advancement symbol (4). There are no play symbol wins.

Figure 6:
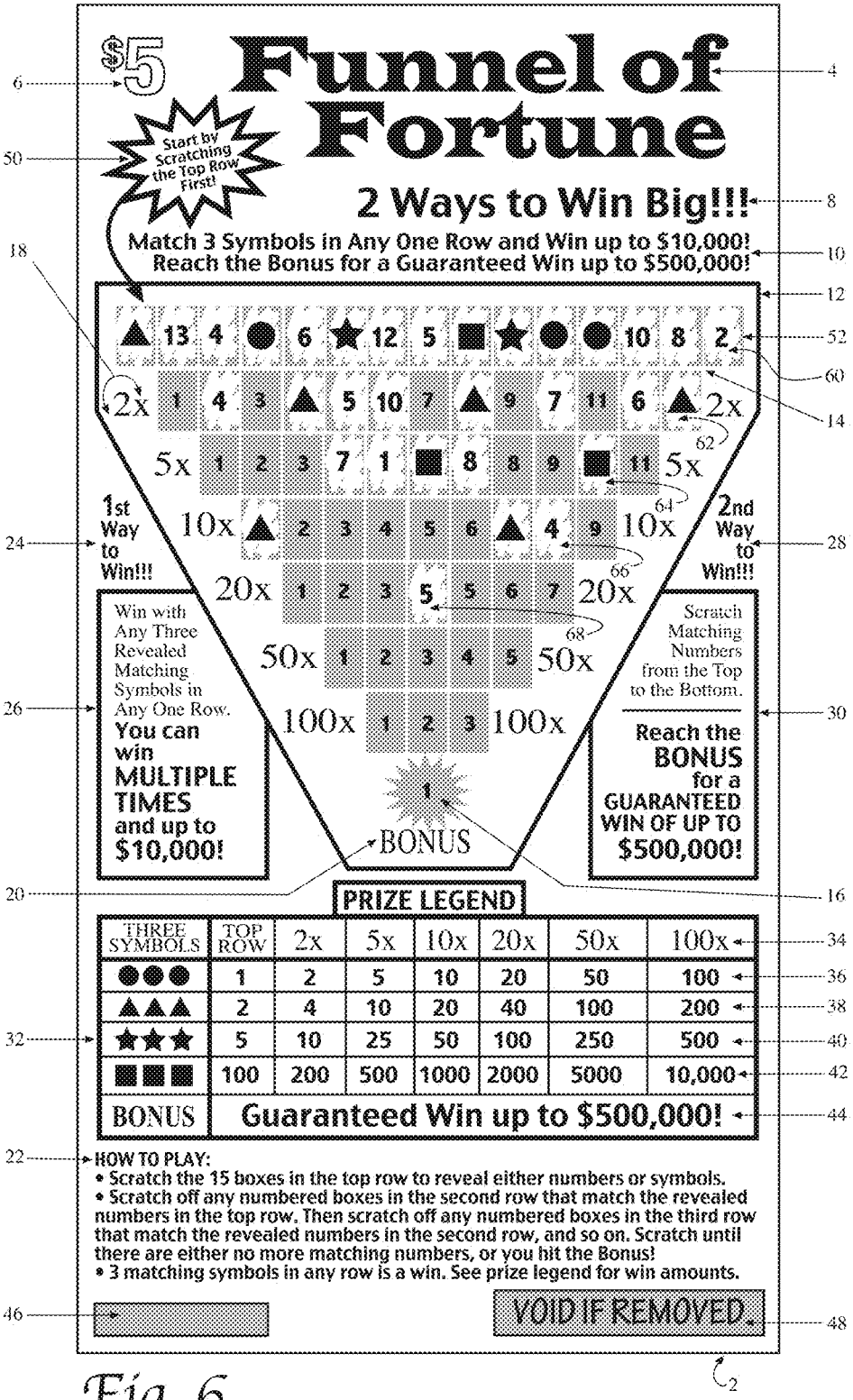
FIG. 6 shows the game technology at a later stage.

FIG. 6 shows the elements of FIG. 5 wherein the player has scratched off the labeled opaque film 68 over the one box in the fifth row that matches the advancement symbol in the fourth row, revealing one advancement symbol (5). There are no play symbols or wins.

Figure 7:
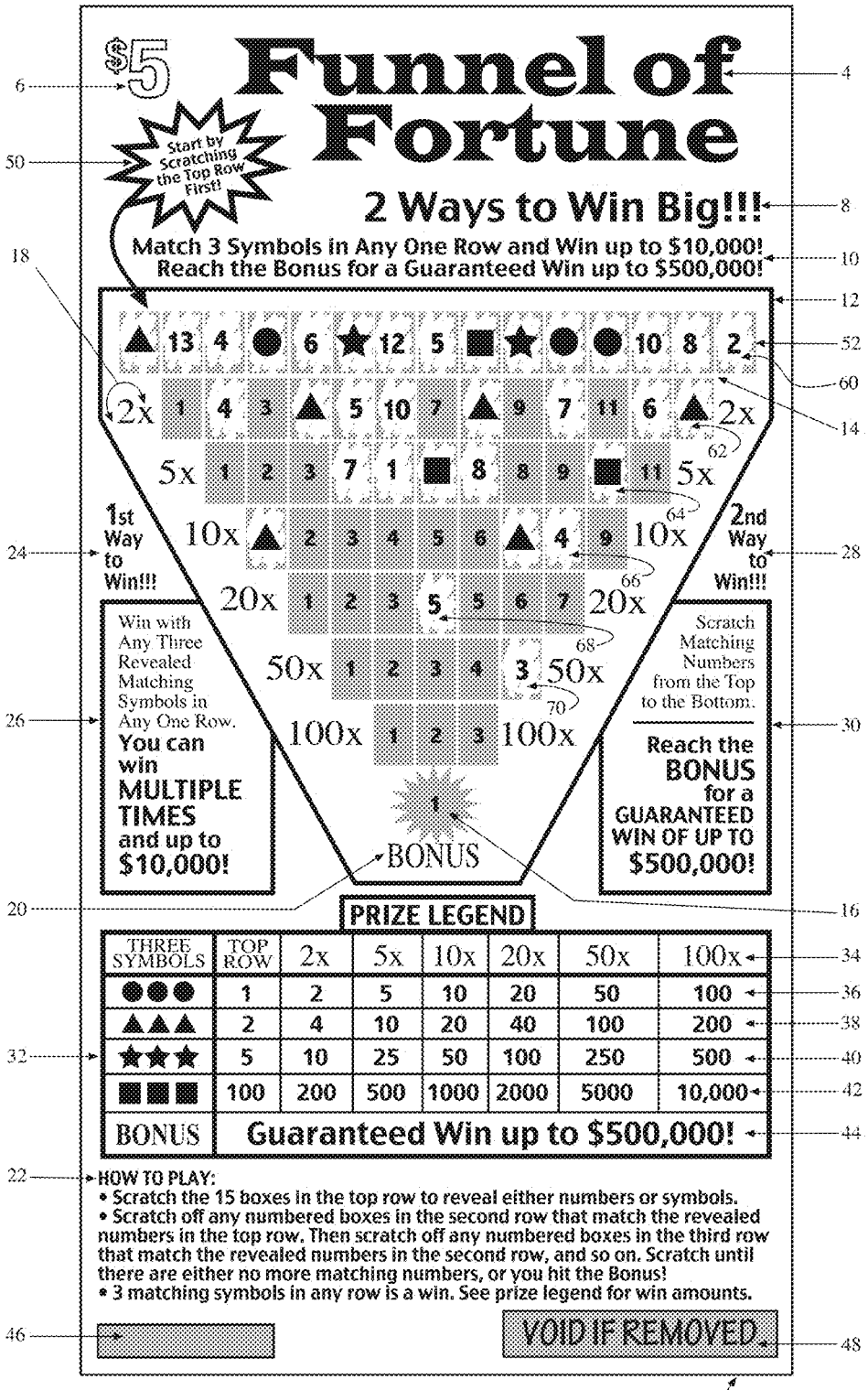
FIG. 7 shows the game technology at a later stage.

FIG. 7 shows the elements of FIG. 6 wherein the player has scratched off the labeled opaque film 70 over the one box in the sixth row that matches the advancement symbol in the fifth row, revealing one advancement symbol (3). There are no play symbols or wins.

Figure 8:
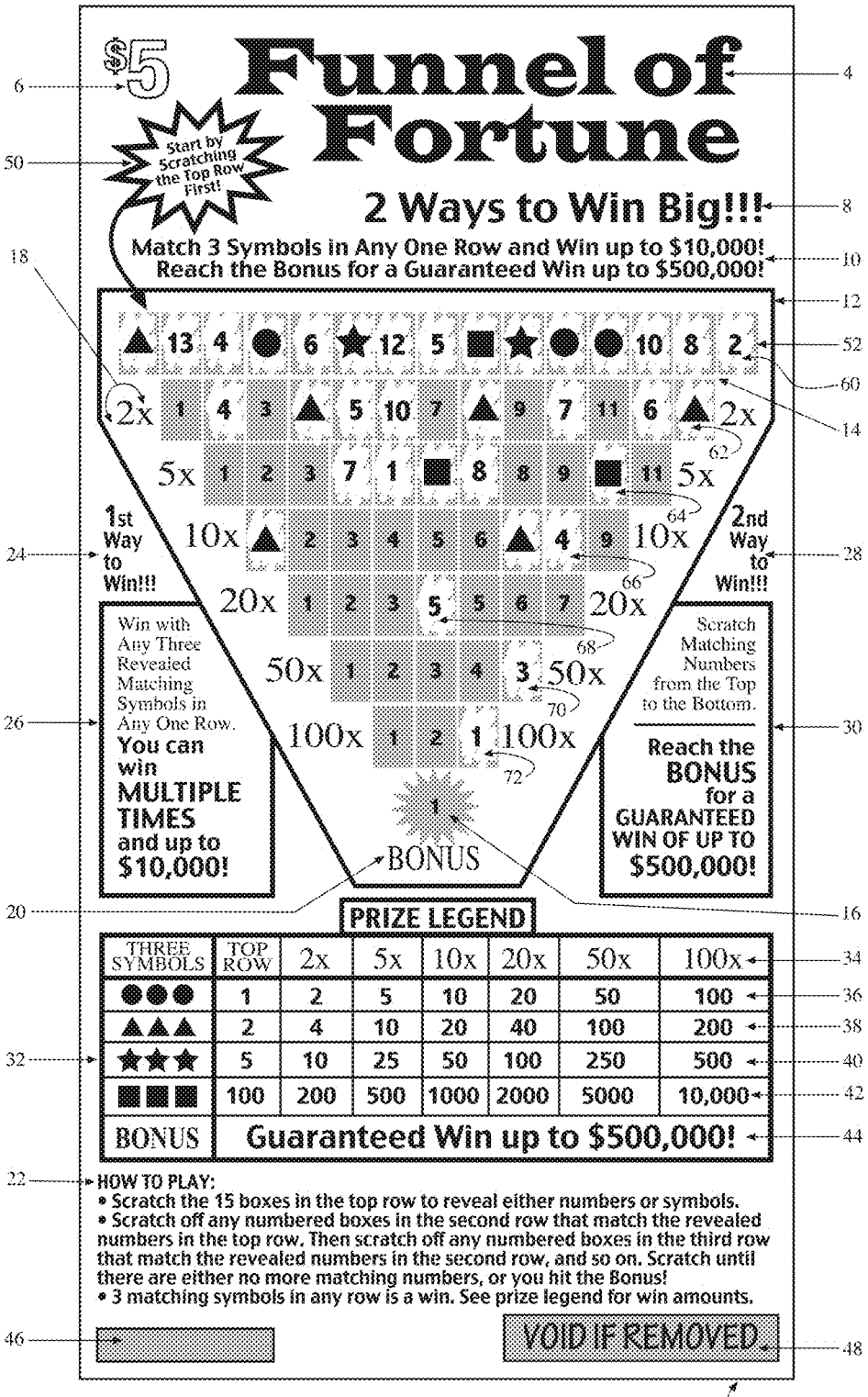
FIG. 8 shows the game technology at a later stage.

FIG. 8 shows the elements of FIG. 7 wherein the player has scratched off the labeled opaque film 72 over the one box in the seventh row that matches the advancement symbol in the sixth row, revealing one advancement symbol (1). There are no play symbols or wins.

Figure 9:
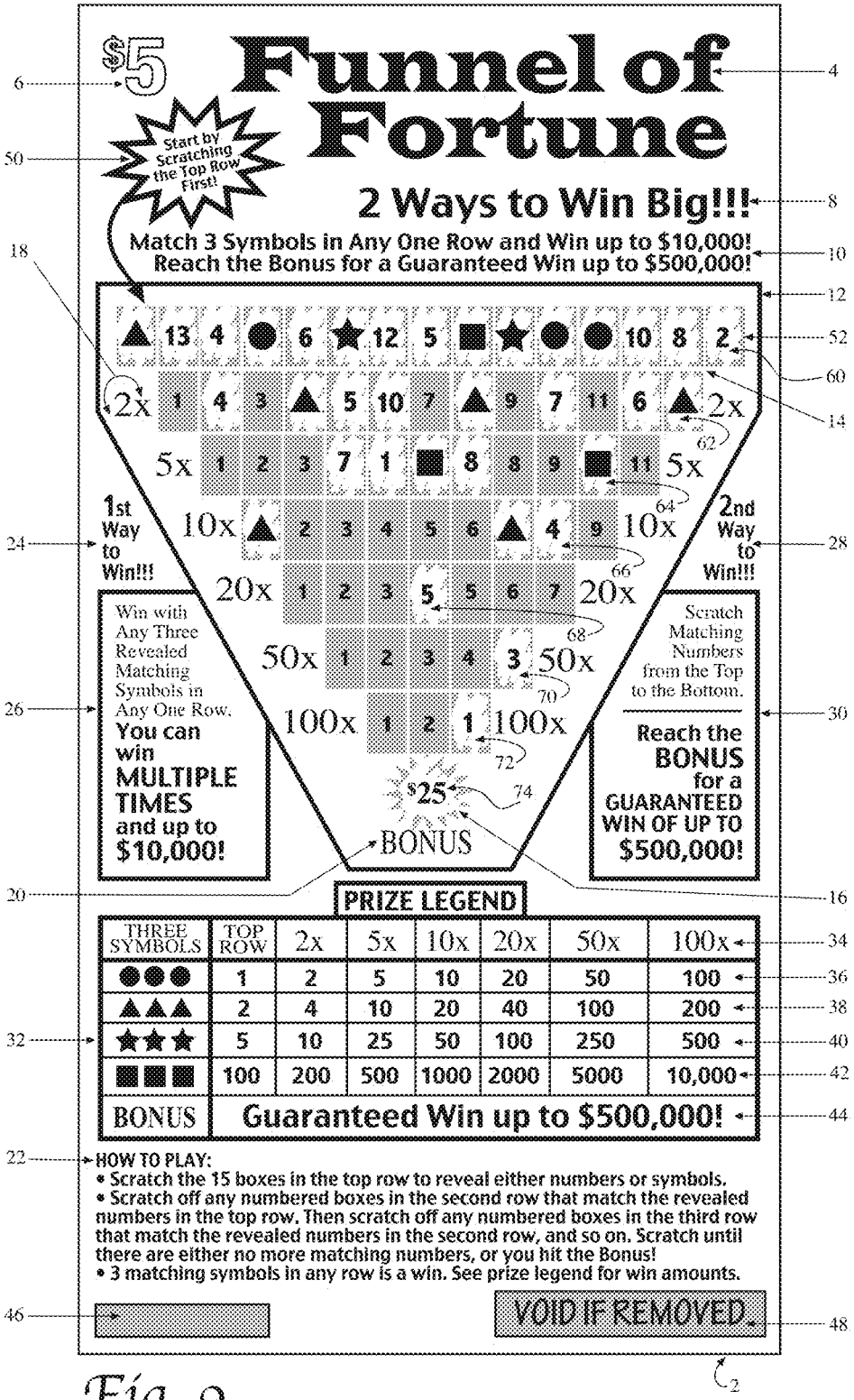
FIG. 9 shows the game technology at a later stage.

FIG. 9 shows the elements of FIG. 8 wherein the player has scratched off the labeled opaque film 74 over the one box in the eighth row that matches the advancement symbol in the seventh row, revealing a guaranteed bonus win of $25.

Figure 10:
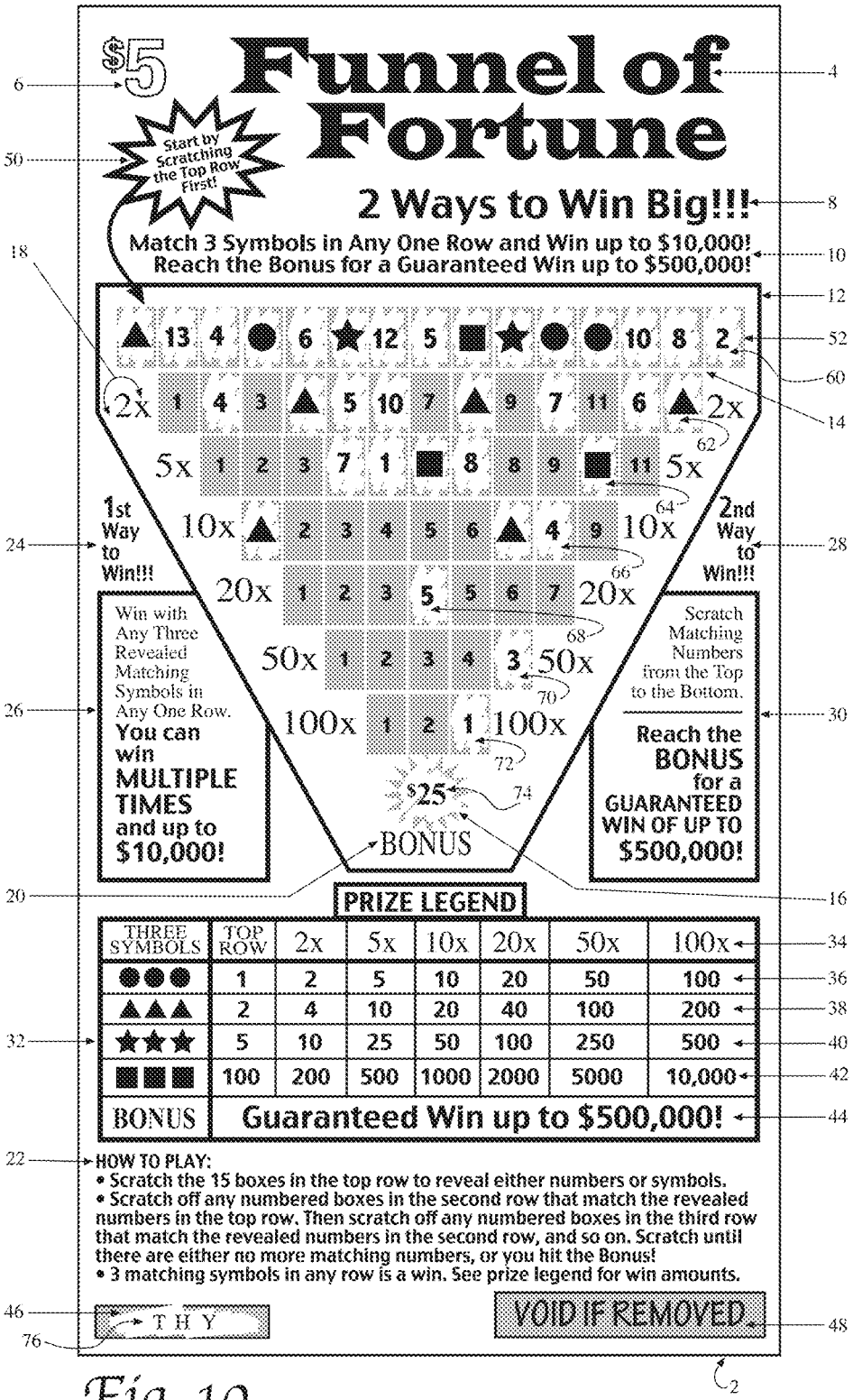
FIG. 10 shows the game technology at a final stage.

FIG. 10 shows the elements of FIG. 9 wherein the player has scratched off the labeled opaque film 76 over the verification code box 46, revealing the code THY for a total prize of $30 ($1+$4+$25).

Figure 11:
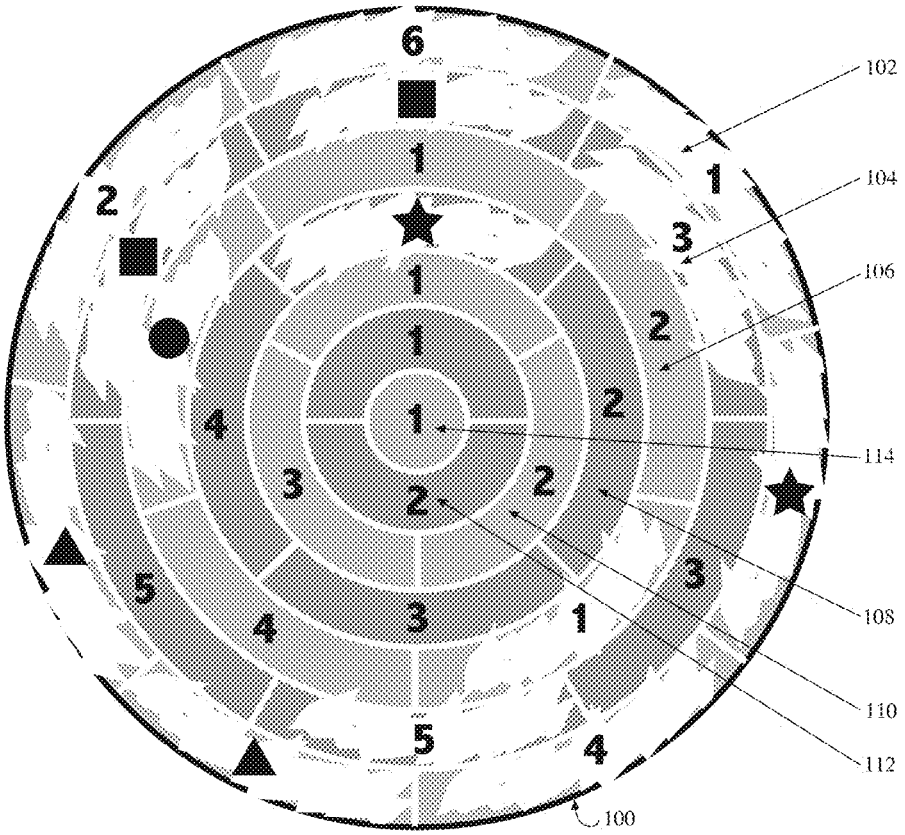
FIG. 11 shows an alternate game grid for an instant ticket game utilizing the game technology of a second preferred embodiment described herein.

FIG. 11 illustrates the elements of an alternative circular game grid on a ticket of the second preferred embodiment of the present invention. The game grid 100 comprises seven concentric circular rows or "rings" of symbol boxes covered by an opaque removable film (as illustrated by a grey dot pattern), and labeled by a number. The game grid is shown at a final stage of resolution, using the film removal method as described herein. There are seven symbol boxes in the outermost (first ring) 102, numbered 1 through 7. The next ring 104 toward the center comprises six symbol boxes numbered 1 through 6. Each successive ring 106, 108, 110, 112 comprises one less labeled symbol box, with the last symbol ring 116 (the center symbol being the Bonus symbol box) being labeled by the number 1. Following the gameplay method as generally described in FIG. 1 through FIG. 10, the player has scratched off the labeled opaque film over all of the symbol boxes in the first, outermost ring 102 to reveal three play symbols (two triangles and one star) and four advancement symbols (in numerical order, 1, 2, 4, 6). There are no symbol wins. The player has next scratched off the labeled opaque film over the four symbol boxes in the second ring 104 that match the advancement symbols in the first ring, revealing two play symbols (two squares) and two advancement symbols (3, 5). There are no play symbol wins. The player has next scratched off the labeled opaque film over the two symbol boxes in the third ring 106 that match the advancement symbols in the second ring, revealing one play symbol (one circle) and one advancement symbol (1). There are no play symbol wins. The player has next scratched off the labeled opaque film over the one symbol box in the fourth ring 108 that matches the advancement symbol in the third ring, revealing one play symbol (one star) and no advancement symbols. There are no play symbol wins. With no advancement symbols revealed, the game is ended, with the result being a losing ticket.

It should be appreciated that the present invention may, as opposed to a physical ticket, provide an electronic ticket displayed on an electronic device that comprises at least a monitor screen, an electronic processor, and an input device. The said electronic ticket uses the same basic gameplay as described above in FIGS. 1 through 10 for the physical ticket, but wherein the player may "scratch off" any opaque layers (in lieu of printed film) by utilizing an input device such as a touchscreen, mouse, button or similar tool. Alternately, the "scratch off" process may be provided by the processor.

Although specific examples and specific win tables have been provided in this discussion, these specifics are intended to be only support for the generic concepts of the invention and are not intended to be absolute limits in the scope of the technology discussed.

What is claimed:

1. A method of conducting a lottery instant scratch ticket game comprising the steps of:

a) providing a plurality of physical scratch tickets;

b) providing a printed grid on each ticket that comprises a predetermined amount of symbol boxes;

c) providing within each symbol box a printed game symbol from either a first predetermined set of game symbols comprising alphanumeric advancement symbols or a second predetermined set of game symbols comprising graphical play symbols;

d) wherein the symbol boxes are displayed in at least three either horizontal or vertical rows;

e) wherein a first row of symbol boxes comprises a largest amount of symbol boxes;

f) wherein each successive row of symbol boxes comprises an ever-decrementing amount of symbol boxes;

g) wherein a last row of symbol boxes comprises a single symbol box;

h) wherein each symbol box is covered by an opaque removable film;

i) wherein the opaque removable film over each specific one row of symbol boxes is labeled by a unique alphanumeric game symbol from the first set of game symbols comprising alphanumeric advancement symbols;

j) providing a prize legend comprising a predetermined paytable for predetermined amounts of like game symbols in any one row of symbol boxes from the second set of game symbols comprising graphical play symbols;

k) providing a film removal method wherein the labeled opaque film over all of the symbol boxes in the first row of symbol boxes is removed to reveal either an alphanumeric advancement symbol or a graphical play symbol in each symbol box;

l) continuing the film removal method by removing the labeled opaque film over any symbol area in the second row that matches an alphanumeric advancement symbol revealed in the first row of symbol boxes;

m) continuing the film removal method by removing the labeled opaque film over any symbol area in each successive row of symbol boxes that matches an alphanumeric advancement symbol revealed in the previous row of symbol boxes;

n) providing a guaranteed winning result comprising a prize symbol if the single symbol box in the last row of symbol boxes is ultimately revealed employing the film removal method;

o) analyzing all revealed game symbols in each single row of symbol boxes to determine if there are any wins of graphical play symbols according to the predetermined prize legend;

p) determining if a value of the win(s) match a single verification code; and q) providing the value of the win(s) as an award.

2. The method of claim 1 wherein the value of the verified instant lottery ticket is then reverified using a security code by processing the ticket through a computer terminal comprised of at least a computer processor.

3. The method of claim 1 wherein the rows of symbol boxes comprise a rectangular, circular or other predetermined geometric grid.

4. The method of claim 3 wherein the first row of symbol boxes in a circular grid is an outermost ring of the grid and the last row of symbol boxes is an innermost ring of the grid.

5. The method of claim 1 where each successive row comprises an ever-incrementing multiplier.

6. The method of claim 1 wherein the amount of symbols from the first predetermined set of game symbols comprising alphanumeric advancement symbols as compared to the amount of symbols from the second predetermined set of game symbols comprising graphical play symbols in any one row provides a perceived greater chance of winning either a guaranteed prize according to the special prize symbol or a prize according to the prize legend.

7. A method of conducting a game that provides an electronic ticket displayed on an electronic device that comprises at least a monitor screen, an electronic processor, and an input device, that comprises the steps of:

a) providing a first grid on the electronic ticket that comprises a predetermined amount of symbol boxes;

b) providing within each symbol box a game symbol from either a first predetermined set of game symbols comprising alphanumeric advancement symbols or a second predetermined set of game symbols comprising graphical play symbols;

c) wherein the symbol boxes are displayed in at least three either horizontal or vertical rows;

d) wherein a first row of symbol boxes comprises a largest amount of symbol boxes;

e) wherein each successive row of symbol boxes comprises a decrementing amount of symbol boxes;

f) wherein a last row of symbol boxes comprises a single symbol box;

g) wherein each symbol box is covered by an opaque removable layer;

h) wherein the opaque removable layer over each specific one row of symbol boxes is labeled by a unique alphanumeric game symbol from the first set of game symbols comprising alphanumeric advancement symbols;

i) providing a prize legend comprising a predetermined paytable for predetermined amounts of like graphical play game symbols in any one row of symbol boxes from the second set of game symbols comprising graphical play symbols;

j) providing a layer removal method wherein the labeled opaque layer over all of the symbol boxes in the first row of symbol boxes is removed to reveal either an alphanumeric advancement symbol or a play symbol in each symbol box;

k) continuing the layer removal method by removing the labeled opaque layer over any symbol area in the second row that matches an alphanumeric advancement symbol revealed in the first row of symbol boxes;

l) continuing the layer removal method by removing the labeled opaque film over any symbol area in each successive row of symbol boxes that matches an alphanumeric advancement symbol revealed in the previous row of symbol boxes;

m) providing a guaranteed winning result comprising a prize symbol if the single symbol box in the last row of symbol boxes is ultimately revealed employing the layer removal method;

n) analyzing all revealed game symbols in each single row of symbol boxes to determine if there are any wins of graphical play symbols according to the predetermined prize legend; and o) providing a value of the win(s) as an award.

8. The method of claim 7 wherein the rows of symbol boxes comprise a rectangular, circular or other predetermined geometric grid.

9. The method of claim 8 wherein the first row of symbol boxes in a circular grid is an outermost ring of the grid and the last row of symbol boxes is an innermost ring of the grid.

10. The method of claim 7 where each successive row comprises an ever-incrementing multiplier.

11. The method of claim 7 wherein the player may remove any opaque layer by utilizing an input device such as a touchscreen, mouse, button or similar tool.

12. The method of claim 7 wherein the processor may function to remove any opaque layer without player input.

13. The method of claim 7 wherein the amount of symbols from the first predetermined set of game symbols comprising alphanumerical advancement symbols as compared to the amount of symbols from the second predetermined set of game symbols comprising graphical play symbols in any one row provides a perceived greater chance of winning either the guaranteed prize or a prize according to the prize legend.

* * * * *